US007618330B2

(12) United States Patent
Krewalk et al.

(10) Patent No.: US 7,618,330 B2
(45) Date of Patent: Nov. 17, 2009

(54) GOLF CLUB

(76) Inventors: John Joseph Krewalk, 14 Pheasant La., Bloomfield, CT (US) 06002; Michael Malerba, 85 Somerset Dr., Manchester, CT (US) 06040

( * ) Notice: Subject to any disclaimer, the term of this patent is extended or adjusted under 35 U.S.C. 154(b) by 0 days.

(21) Appl. No.: 11/859,056

(22) Filed: Sep. 21, 2007

(65) Prior Publication Data

US 2008/0009365 A1 Jan. 10, 2008

Related U.S. Application Data

(63) Continuation-in-part of application No. 11/311,710, filed on Dec. 20, 2005, now abandoned.

(51) Int. Cl.
*A63B 53/04* (2006.01)

(52) U.S. Cl. ..... 473/328; 473/350

(58) Field of Classification Search ..... 473/327–328, 473/228; D21/747, 752
See application file for complete search history.

(56) References Cited

U.S. PATENT DOCUMENTS

| | | | | | |
|---|---|---|---|---|---|
| D44,457 | S | * | 8/1913 | Taylor | D21/751 |
| 1,089,881 | A | | 3/1914 | Taylor | |
| 1,505,296 | A | * | 8/1924 | Smith | 473/382 |
| D212,293 | S | | 9/1968 | Brown | |
| 3,997,170 | A | * | 12/1976 | Goldberg | 473/327 |
| 4,065,133 | A | | 12/1977 | Gordos | |
| D344,560 | S | * | 2/1994 | Katayama | D21/752 |
| 5,294,122 | A | * | 3/1994 | Longo | 473/328 |
| 5,464,217 | A | * | 11/1995 | Shenoha et al. | 473/350 |
| 5,597,364 | A | * | 1/1997 | Thompson | 473/314 |
| 5,603,668 | A | | 2/1997 | Antonious | |
| D380,512 | S | * | 7/1997 | Oku | D21/752 |
| D394,688 | S | * | 5/1998 | Fox | D21/733 |
| 5,762,566 | A | | 6/1998 | King et al. | |
| 6,517,449 | B2 | | 2/2003 | Otoguro | |
| 6,846,246 | B2 | | 1/2005 | Asplund | |
| D524,889 | S | * | 7/2006 | Yu et al. | D21/747 |
| 2005/0064953 | A1 | | 3/2005 | Moore | |

* cited by examiner

*Primary Examiner*—Sebastiano Passaniti
(74) *Attorney, Agent, or Firm*—Jay Schloff

(57) ABSTRACT

Disclosed herein is a golf club, comprising a shaft and a golf club head disposed at one end of the shaft. The golf club head has a face on a front of the golf club head, a cavity surface on a back of the golf club head, and a bottom flange extending from a bottom edge of the face to a bottom edge of the cavity. The bottom flange has a plurality of grooved channels extending across a width of the bottom flange of the golf club head, such that the golf club head provides a flow path, permitting a medium to flow through the grooved channels, thereby reducing resistance to motion of the golf club head during play.

10 Claims, 4 Drawing Sheets

GOLF CLUB

CROSS REFERENCE TO RELATED APPLICATIONS

The present application is a continuation-in-part of, and is entitled to the benefit of the earlier filing date and priority of, U.S. patent application Ser. No. 11/311,710, which names the same inventors as the current application, entitled "GOLF CLUB," filed Dec. 20, 2005 now abandoned, the disclosure of which is hereby incorporated by reference.

FIELD OF THE INVENTION

The present invention relates generally to golf clubs, and, more particularly, to sand wedge golf club having grooved channels for enabling easy movement of golf clubs in sand and like medium thereby providing relief to the golfers.

BACKGROUND OF THE INVENTION

The game of golf is one of the leading leisure time outdoor sporting activities which enlist participants of all ages. In hitting the links, golfers not only enjoy the satisfaction of getting out in the fresh air and playing the game, they also gain the benefit of exercise in swinging the clubs and walking to several miles. Mediums on the golf course, like sand, grass and the like pose some of the most difficult circumstances to the golfers during strokes. During the explosion stroke, which is used to lift out the golf ball out of the sand trap, sand is lifted alongwith the golf ball and hinders the movement of the golf club. This is the major problem which troubles golfers while executing the explosion stroke effectively. Due to these obstructions, a golfer may not execute strokes properly and as a result, the golf ball does not always reach the destination aimed at.

A number of golf clubs have been developed to deal with the above mentioned situations faced by golfers on a golf course. Conventional sand wedge golf clubs rely on weight to "push" their way through the sand. These conventional wedges have flat surfaces on the bottom flange section where they make contact with the medium.

U.S. Patent Publication No. 20050064953 discloses a golf club head having a face, a toe, a sole and a neck. A plurality of slots is spaced apart with each of the slots extending from the sole upwardly medially within the head. The slots are in parallel correspondence, having flat side walls that terminate upwardly with a circular surface, and diverge in width from the face to the back of the club, so that they present the least resistance when the club moves through sand. The slots of the present invention also extend across the face of the golf club head thereby reducing the surface of contact of the face with the golf ball.

U.S. patent publication No. 20020173375 discloses a slotted golf club head for reducing the obstruction of an obstacle such as sand, water, or grass when striking a golf ball. The slotted golf club head having: a wide club sole that prevents the golf club head from being encumbered by the hazard or obstacle, a club face having an un-slotted upper portion adapted to provide an un-slotted striking surface for the golf ball, and a slotted lower portion having a plurality of slots for allowing an obstacle to pass through the golf club head. The slots extend from the club face through the club body. The slot bottoms extend through the sole allowing the slot bottoms to be straight and substantially level with the club sole. The slots of the present invention also extend across the face of the golf club head and reduces the surface of contact of the face with the golf ball.

U.S. Pat. No. 5,603,668 discloses an iron type golf club head with an improved sole construction including cavities and/or projections in various shapes. The cavities and projections on the sole are spaced behind the leading edge of the club head and include a substantially vertical wall facing the leading edge of the golf club head. The configuration of the golf club head does not effectively serve in providing an easier movement of the golf club through sand.

The conventional golf clubs are inconvenient and inefficient. None of the prior art particularly discusses the use of sand wedge golf clubs that permit the sand to pass through the bottom surface of the golf club head in a quick, easy, and effective manner. Due to this, there is a resistance to the motion of the golf club through sand. Further, these golf clubs do not allow the golfer to have the club glide or swing through the sand easily.

Accordingly, there remains a need for a sand wedge golf club that enables the club to glide or swing through the sand easily, to stay straight through the shot so that the ball goes where it is aimed at, and to provide relief to the golfer.

SUMMARY OF THE INVENTION

In view of the foregoing disadvantages inherent in the above-mentioned prior arts, the general purpose of the present invention is to provide a golf club, to include all the advantages of the prior art, and to overcome the above-mentioned disadvantages/drawbacks inherent therein.

In an aspect, the present invention provides a golf club comprising a shaft and a golf club head disposed at one end of the shaft. The golf club head has a face on a front of the golf club head, a cavity surface on a back of the golf club head, and a bottom flange extending from a bottom edge of the face to a bottom edge of the cavity. The bottom flange has a plurality of grooved channels extending across a width of the bottom flange of the golf club head.

In another aspect, the present invention provides a golf club head comprising a face on a front of the golf club head, a cavity surface on a back of the golf club head, and a bottom flange extending from a bottom edge of the face to a bottom edge of the cavity. The bottom flange has a plurality of grooved channels extending across a width of the bottom flange of the golf club head, such that, the golf club head provides a flow path, permitting a medium to flow through the grooved channels, thereby reducing resistance to motion of the golf club head during play.

These together with other aspects of the present invention, along with the various features of novelty that characterize the invention, are pointed out with particularity in the claims annexed hereto and forming a part of this disclosure. For a better understanding of the invention, its operating advantages and the specific objects attained by its uses, reference should be made to the accompanying drawings and descriptive matter in which there are illustrated exemplary embodiments of the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

The exemplary embodiments described herein detail for illustrative purposes are subject to many variations in structure and design. It should be emphasized, however that the present invention is not limited to a particular golf club as shown and described. It is understood that various omissions, substitutions of equivalents are contemplated as circumstances may suggest or render expedient, but is intended to cover the application or implementation without departing from the spirit or scope of the claims of the present invention.

The terms "a" and "an" used herein do not denote a limitation of quantity, but rather denote the presence of at least one of the referenced items.

Figure 1:
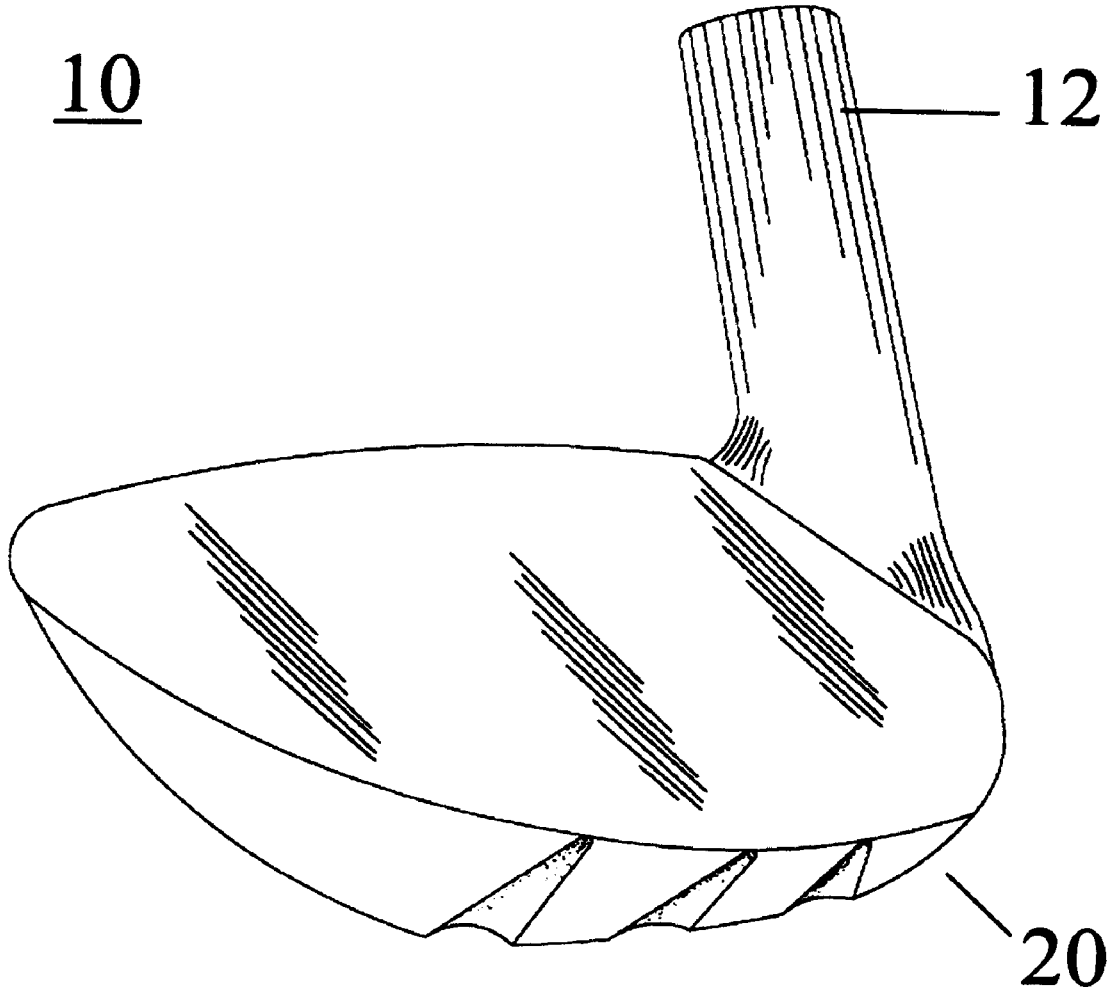
FIG. 1 is a front perspective view of a golf club 10, according to an exemplary embodiment of the present invention.
Figure 2:
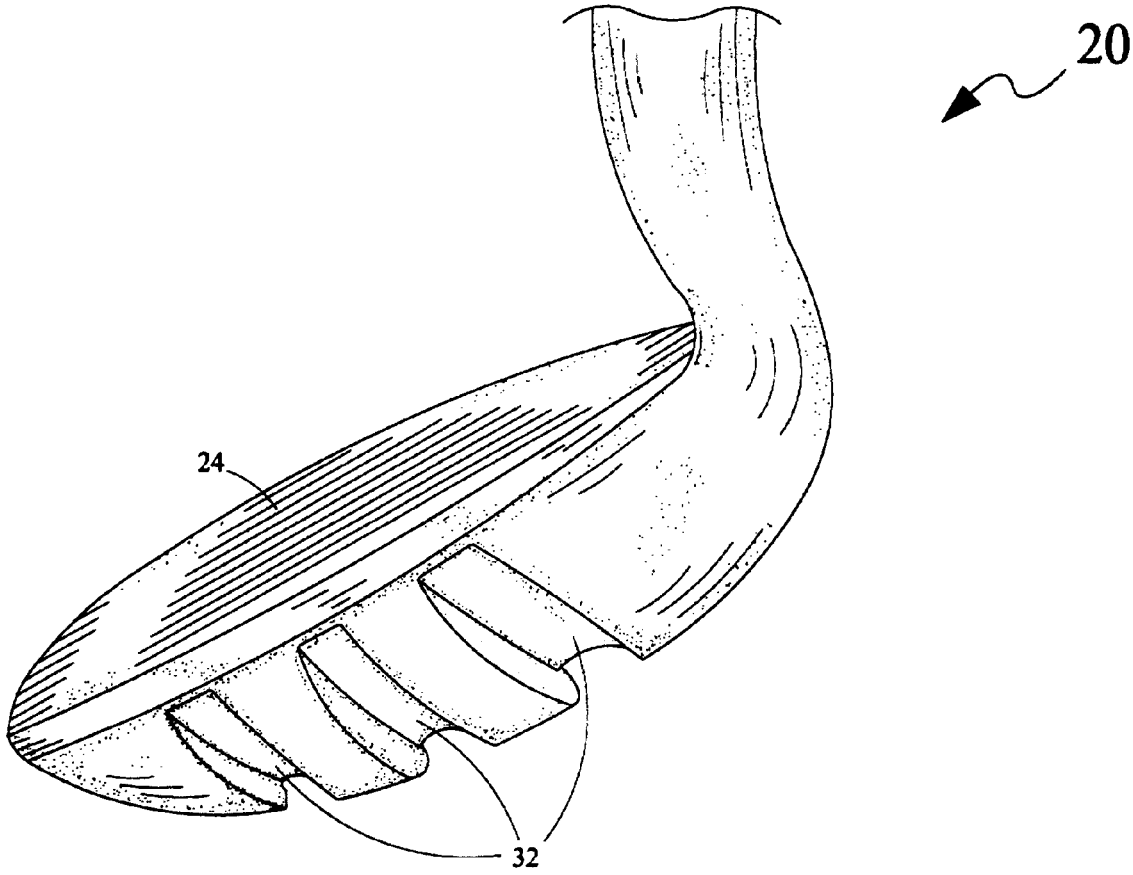
FIG. 2 is a front bottom perspective view of a golf club head 20, according to an exemplary embodiment of the present invention.
Figure 3:
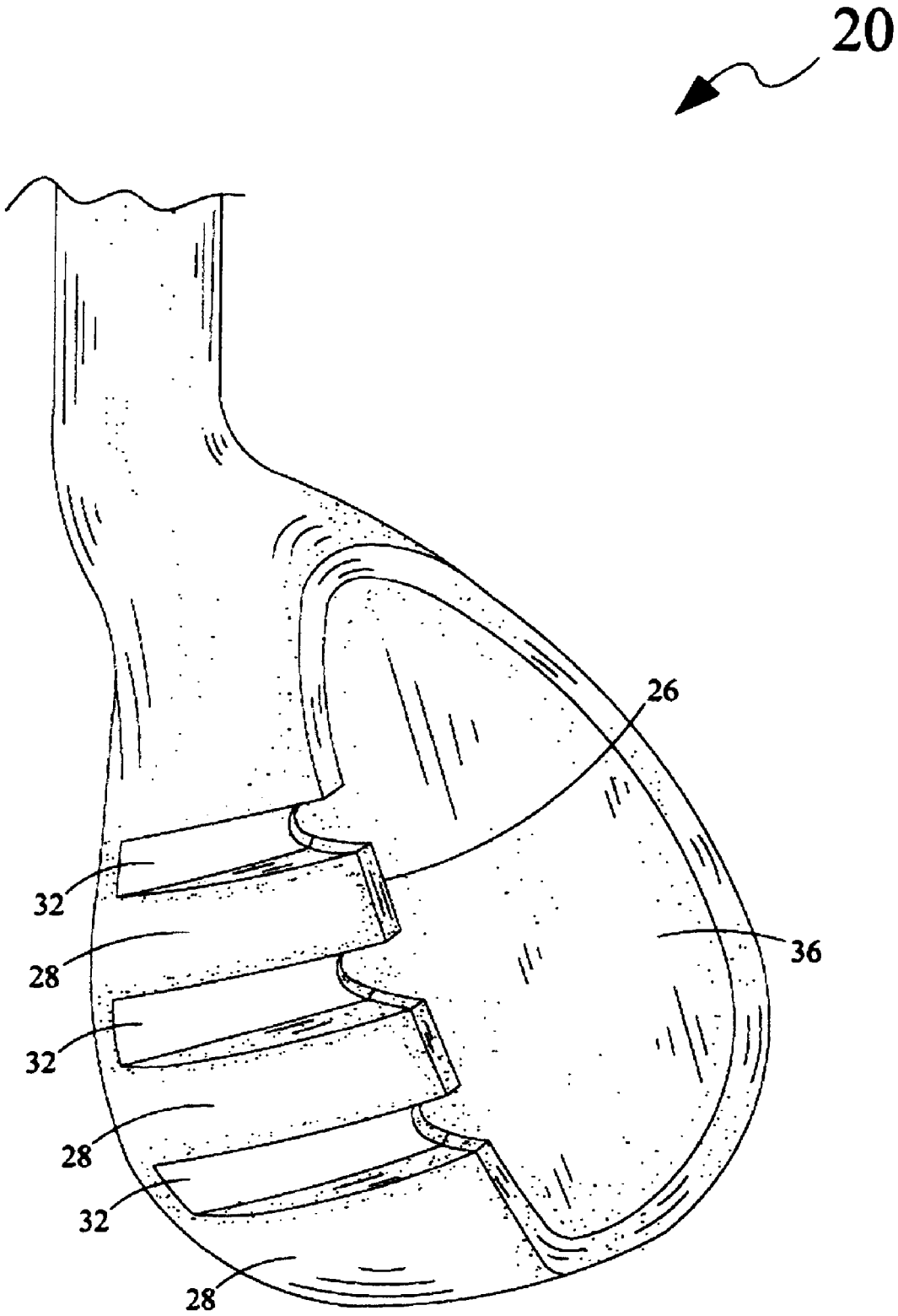
FIG. 3 is a back bottom perspective view of the golf club head 20, according to an exemplary embodiment of the present invention.
Figure 4:
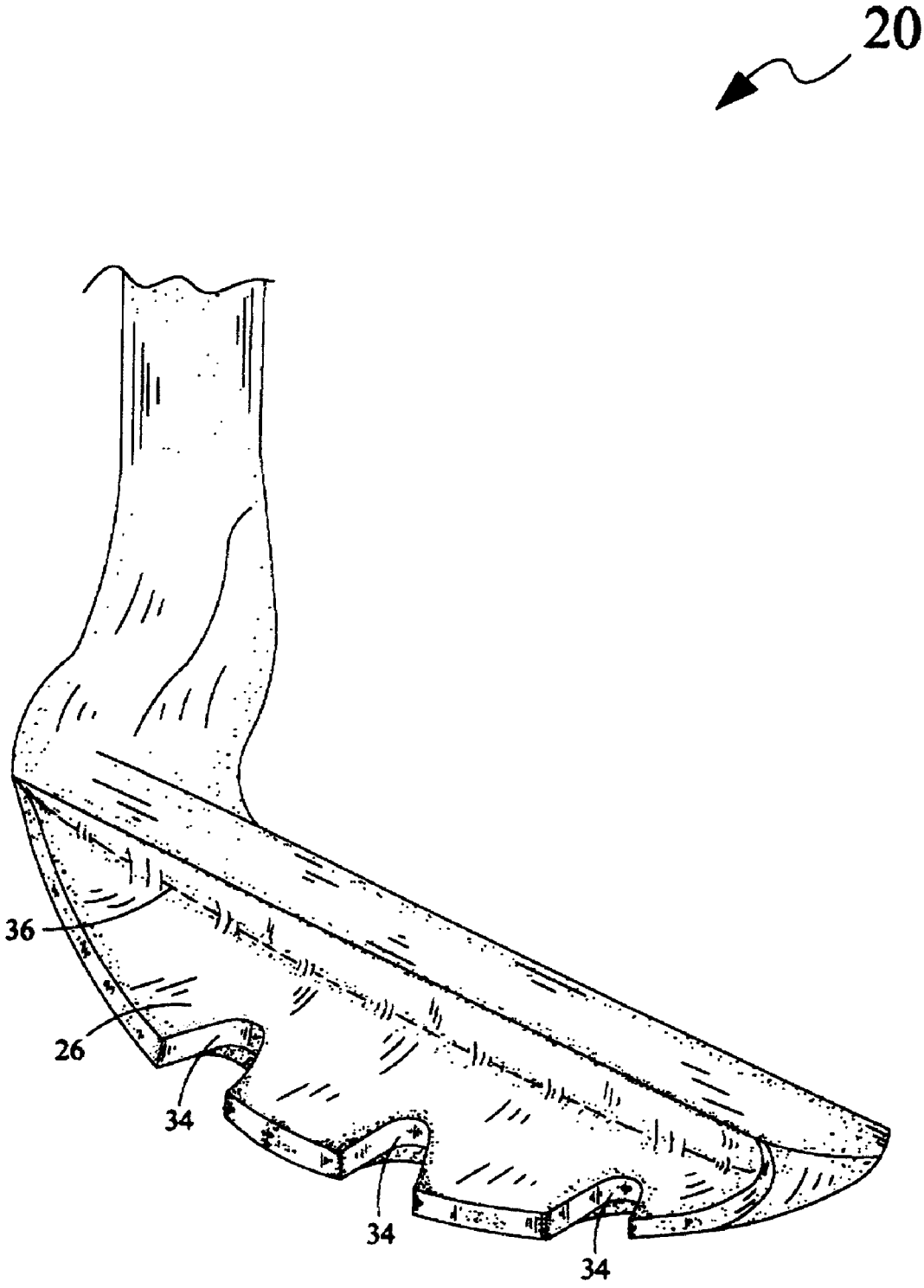
FIG. 4 is a back perspective view of the golf club 20, according to an exemplary embodiment of the present invention; and Like reference numerals refer to like parts throughout several views of the drawings.

Referring now to FIGS. 1-4, in one embodiment, a golf club 10 comprises a shaft 12 and a golf club head 20 disposed at one end of the shaft 12. The golf club head 20 comprises a face 24 on a front of the golf club head 20 (i.e., face 24 is a front surface of the golf club head 20), a cavity surface 36 on a back of the golf club head 20 (i.e., cavity surface 36 is a back surface of the golf club head), and a bottom flange 26 extending from a bottom edge 28 of the face 24 to a bottom edge 30 of the cavity surface 36 (i.e., bottom flange 26 is a bottom surface of the golf club head 20). In said configuration, the face 24 of the golf club 10, is adapted to strike a golf ball, such that the bottom flange 26 contacts a medium (e.g., sand, dirt, grass, and the like) on which the golf ball is placed. The bottom flange 26 provides mass and a lower center of gravity to golf club head 20. The cavity surface 36 allows mass to be distributed to the bottom flange 26, imparting balance and a lower center of gravity to the bottom flange 26 of the golf club head 20.

The bottom flange 26 has a plurality of grooved channels 32 extending across an entire width of the bottom flange 26 from the front to the back of the golf club head. The grooved channels 32 are wide and deep enough to provide a flow path, permitting sand (or other medium) to flow through the grooved channels 32, thereby reducing the resistance to the motion of the golf club head 20 during play. The presence of the grooved channels 32 allows a golfer to swing the golf club 10 in an easy manner. Also, the grooved channels 32 are substantially perpendicular to the face 22 of the golf club head 20, and parallel to swing of the golf club 10, thereby enabling the golf club 10 to stay straight through out the shot. Due to such a feature a golf ball goes in the direction in which it is aimed.

In one embodiment of the present invention wherein the edge of said bottom flange 26 that is distal to the face of said club further comprises semicircular indentations 34 that correspond to the end of the channels 32 that are distal to the face of said club. The semicircular indentations 34 further contribute to the flow path of the club after the club strikes the ball and the club travels in a generally upward trajectory away from the surface from which the ball has been struck with the club. The semicircular indentations 34 further decrease the resistance of the club as the club passes through and away from the playing surface.

Preferably, the grooved channels 32 have a depth that extends throughout the thickness of the bottom flange 26, but are not deep enough to extend into the face 24. Also, the grooved channels 32 are uniformly spaced and uniform in width. Each grooved channel 32 comprises a first sidewall and a second sidewall initiating at and extending away from the bottom flange 26. The first sidewall and second sidewall of each grooved channel 32 are perpendicular to the bottom flange 26 where the sidewalls initiate at the bottom flange 26. Here, the grooved channels 32 terminate substantially adjacent to the face 24. The depth of the grooved channels' penetration into the bottom flange 26 increases from a lesser depth at the termination of the channels 32 that is proximate to the face 24 of the golf club head 20 to a greater depth at the termination of the channels 32 that is distal to the face 24 of the golf club head 20. The mass removed from the sole due to the formation of the grooved channels 32 is significantly lesser than the remaining mass on the bottom flange 26, thereby not affecting the mass and lowered center of gravity at the bottom flange 26.

The bottom flange 26 extends a sufficient distance away from the club face 24 and is of sufficient mass to compensate for the club mass lost by virtue of the incorporation of the channels 32. The bottom flange 26 also lowers the center of gravity of the club to improve the ease of use of the club.

Optionally, the face 24 of the golf club head 20 has a plurality of depression channels (not shown), extending substantially parallel to the bottom edge 28 of the face 24. The depression channels provide a less smooth surface of the face 24 for better contact of the golf ball. Other patterns or grooves may be substituted in alternative embodiments.

The shaft 12 may disposed at a variety of angles with respect to the golf club head 20 such that the golf club 10 may be optimally adapted to the particular swing pattern of the individual user of the club 10. In one embodiment of the present invention, the golf club head 20 is offset from the shaft 12 such that the club head 20 is disposed in a plane behind the shaft 12. In this embodiment, the offset disposition of the golf club head 20 behind the shaft 12 further improves the accuracy of golf shots by keeping the user's hands behind the golf ball when the club 10 strikes the ball.

The foregoing description of specific embodiments of the present invention has been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. A golf club, consisting of:

a shaft;

a golf club head disposed at one end of the shaft, said golf club head having:

a face on a front of said golf club head;

a cavity surface on a back of said golf club head; and a bottom flange extending from a bottom edge of said face to a bottom edge of said cavity, said bottom flange having three grooved channels disposed across a width of said bottom flange of said golf club head, wherein said width is measured in a dimension that is substantially parallel to the face of said club head, wherein each grooved channel of the three grooved channels comprises a first sidewall and a second sidewall initiating at and extending away from the bottom flange, wherein said first sidewall and second sidewall of each grooved channel of the three grooved channels are perpendicular to the bottom flange where said sidewalls initiate at the bottom flange, wherein the extension of said grooved channels terminates at a point on said bottom flange such that said grooved channels are not disposed on said face of said club and wherein said grooved channels terminate substantially adjacent to the face of said club, wherein said termination of said grooved channels is such that said channels are disposed on the remaining length of the bottom flange, wherein said length is a dimension measured from the face of said club head to the cavity of said club head, and wherein the depth of the grooved channels' penetration into the bottom flange increases from a lesser depth at the termination of the channels that is proximate to the face of the golf club head to a greater depth at the termination of the channels that is distal to the face of the golf club head.

2. The golf club as claimed in claim 1, wherein said grooved channels are substantially perpendicular to said face of said golf club head.

3. The golf club as claimed in claim 1, wherein said grooved channels are uniformly spaced and uniform in width.

4. The golf club as claimed in claim 1, wherein the edge of said bottom flange that is distal to the face of said club further comprises semicircular indentations that correspond to the end of the channels that are distal to the face of said club.

5. The golf club as claimed in claim 1, wherein said golf club head is offset from said shaft such that the golf club head is disposed in a plane behind the shaft.

6. A golf club head, consisting of:

a face on a front of said golf club head;

a cavity surface on a back of said golf club head; and a bottom flange extending from a bottom edge of said face to a bottom edge of said cavity, the bottom flange having three grooved channels disposed across a width of said bottom flange of said golf club head, wherein said width is measured in a dimension that is substantially parallel to the face of said club head, such that, said golf club head provides a flow path, permitting a medium to flow through said grooved channels, thereby reducing resistance to motion of the golf club head during play, wherein each grooved channel of the three grooved channels comprises a first sidewall and a second sidewall initiating at and extending away from the bottom flange, wherein said first sidewall and second sidewall of each grooved channel of the three grooved channels are perpendicular to the bottom flange where said sidewalls initiate at the bottom flange, wherein the extension of said grooved channels terminates at a point on said bottom flange such that said grooved channels are not disposed on said face of said club head and wherein said grooved channels terminate substantially adjacent to the face of said club, wherein said termination of said grooved channels is such that said channels are disposed on the remaining length of the bottom flange, wherein said length is a dimension measured from the face of said club head to the cavity of said club head, and wherein the depth of the grooved channels' penetration into the bottom flange increases from a lesser depth at the termination of the channels that is proximate to the face of the golf club head to a greater depth at the termination of the channels that is distal to the face of the golf club head.

7. The golf club head as claimed in claim 6 wherein said flow path is capable of receiving a medium of at least one of sand, water, grass, mud.

8. The golf club head as claimed in claim 6, wherein said grooved channels are substantially perpendicular to said face of said golf club head.

9. The golf club head as claimed in claim 6, wherein said grooved channels are uniformly spaced and uniform in width.

10. The golf club head as claimed in claim 6, wherein the edge of said bottom flange that is distal to the face of said club head further comprises semicircular indentations that correspond to the end of the channels that are distal to the face of said club head.

* * * * *